US005188284A

United States Patent [19]

Eisman

[11] Patent Number: 5,188,284

[45] Date of Patent: Feb. 23, 1993

[54] CARTON WITH LUG LOCKED TRAY AND COVER

[75] Inventor: Larry Eisman, Elkins Park, Pa.

[73] Assignee: Dopaco, Inc., Downingtown, Pa.

[21] Appl. No.: 833,114

[22] Filed: Feb. 10, 1992

[51] Int. Cl.[5] ..... B65D 5/22; B65D 5/66

[52] U.S. Cl. ..... 229/110; 229/114; 229/125.27; 229/146; 229/901; 229/906

[58] Field of Search ..... 229/110, 112, 113, 114, 229/125.27, 146, 148, 150, 178, 901, 902, 906

[56] References Cited

U.S. PATENT DOCUMENTS

| | | | |
|---|---|---|---|
| 3,027,062 | 3/1962 | Huss et al. | 229/114 |
| 3,410,475 | 11/1968 | Wagner | 229/178 |
| 4,620,666 | 11/1986 | Lacasa et al. | 229/110 |
| 4,809,908 | 3/1989 | Keefe et al. | 229/150 |
| 4,856,707 | 8/1989 | Lorenz | 229/114 |
| 4,877,178 | 10/1989 | Eisman | 229/114 |
| 4,930,681 | 6/1990 | Fultz et al. | 229/906 |
| 5,037,026 | 8/1991 | Hanko | 229/114 |

*Primary Examiner*—Gary E. Elkins

*Attorney, Agent, or Firm*—Dennison, Meserole, Pollack & Scheiner

[57] ABSTRACT

In a carton comprising a tray and a removable cover, peripheral walls on the cover and tray overlapping and engaging each other. Outwardly projecting locking lugs on the cover and tray walls cross each other and interlock upon a movement of the cover to a closed position over the tray and provide spaced points of interlock about the periphery of the carton.

7 Claims, 6 Drawing Sheets

CARTON WITH LUG LOCKED TRAY AND COVER

BACKGROUND OF THE INVENTION

Closed cartons or containers, particularly those used in the fast food industry wherein only a single use is contemplated, are conventionally formed to not only accommodate the particular goods therein, but also to in themselves provide a practical and economically feasible product The carton must be able to not only close and lock in a positive manner, but also easily open for access to the carton contents. An example of such a carton, using interengaging projecting detents and detent receiving slits will be noted in applicant's prior U.S. Pat. No. 4,877,178, issued Oct. 31, 1989.

Known fast food cartons, whether folded from paperboard blanks or of molded paperboard or synthetic resinous materials, are, for ease of storage and shipment, designed for compact nesting. While this ability to nest significantly contributes to the practicability of shipping the assembled cartons to the user, as opposed to requiring the user to assemble the cartons at the point of use, in those instances wherein the tray and cover are completely separable components, note for example FIGS. 5-9 of U.S. Pat. No. 4,877,178, the user must be provided with a stock of both types of components. This in turn requires that the user of the cartons maintain an equal supply of both components and provide accessibility to both supplies. As can be appreciated, particularly in a limited space, this will require substantially double storage capability.

The conventional two part carton, in providing for an interlock between the tray and cover, form each of these components with complementary although different interlocking means, normally projections or tabs on one component and tab receiving recesses, slits or notches on the companion component.

The provision of two distinct components respectively defining the tray and cover of the cartons also necessitates substantial expense in that separate cutting dies are required and time must be allocated to produce two separate forms of components. In addition, there must be coordination in the production of the two sets of components and in the storage and shipping of the separate components.

Another problem encountered in providing fast food cartons in particular is the necessity for providing substantial structural stability at minimal cost both in materials and in production. One area of weakness normally found in such cartons is at the internal slits, notches or openings through the material of the carton in either or both of the tray and lid for cooperation with complementary projections on the second component. Such openings not only weaken the material and provide for potential tear areas, but also tend to interrupt areas on which printed copy or indicia appears. In addition, the actual formation of such openings and the removal of the cut material from the blank at the time of forming is an inherently complex procedure.

SUMMARY OF THE INVENTION

The carton of the present invention is a closed compartment comprising a tray and a cover with complementary interlocking elements provided exterior of the tray and cover walls, and with the walls remaining imperforate. So configured, there is no breaching of the continuity and structural integrity of the carton walls.

Basically, in the cartons of the invention, whether of two completely separable generally duplicate components or of the clam-shell type wherein the cover is hinged to the tray, the coupling or interlocking elements comprise substantially duplicate locking lugs oriented, at each point of interlock, to cross each other at an angle to provide for a snap action interlock of one beneath the other as the cover and tray are moved into closed relationship.

A significant object of the invention is to provide for completely separable trays and lids without the normal problems associated with the formation of two structurally distinct components, thus reducing both make ready time and production equipment costs.

The present invention provides for cartons with completely separable trays and covers wherein each cover is basically a structural duplicate of the associated tray and mountable thereto by inverting one component relative to the other and rotating the inverted component to a predetermined angular relationship to the other component whereby duplicate locking elements are oriented to cross each other and snap lock into engagement upon a bringing of the two components together The provision of a single component configuration for both the tray and cover provides for economies in all aspects of the production and use of the carton in that only one component configuration need be formed, shipped, stored and assembled. Inventory requirements are reduced in that there is no need to determine different quantities for separate trays and covers. This is the case regardless of whether the components are used singly for "eat-in" situations, or in pairs as a closed carton for "take-out".

The actual assembly of the single configuration components requires only an alignment of the tray and cover components and a bringing of these components into interlocking relation with each other, this being no more difficult or complex, and probably less so, than with two differently formed components. Further, and with regard to the ease of assembly, it is complemented that the interlocking elements be external of the tray and cover components at the corners thereof with the ready visibility of these elements facilitating alignment and engagement insuring consistency of locking, and providing an immediate visual indication of a proper interlock. The corner locks also provide for improved rigidity and strength. This in turn allows use of lighter paperboard calibers.

The advantages of the single design component are achieved by formation of the component with peripheral side walls. Selected ones of these walls, or portions thereof, are relatively higher and include integral locking lugs formed thereon and projecting transversely beyond the adjacent wall at each corner of the tray/cover. The arrangement of these locking lugs is such whereby upon the inverting of one component relative to the other and a predetermined rotation of the upper component, the locking lugs are oriented at a crossing angle to each other and interlock upon a bringing of the cover onto the tray. This rotation to interlock the components will depend on the basic configuration of the tray/cover component. For example, if square, the cover will be rotated 90 degrees relative to the tray. If rectangular, the cover will be rotated 180 degrees to the tray. If hexagonal, a 60 degree rotation will be involved.

Other objects and advantages of the invention will become apparent from the more detailed description of the construction and manner of use of the cartons of the invention as more fully hereinafter described and claimed.

DESCRIPTION OF PREFERRED EMBODIMENTS

Referring now more specifically to the drawings, attention is initially directed to FIGS. 1–4 wherein a carton 10, constructed in accord with the present invention, has been illustrated. The carton 10 is formed of structurally duplicate square components, an upwardly opening tray 12 and a downwardly opening cover 14.

Figure 3:
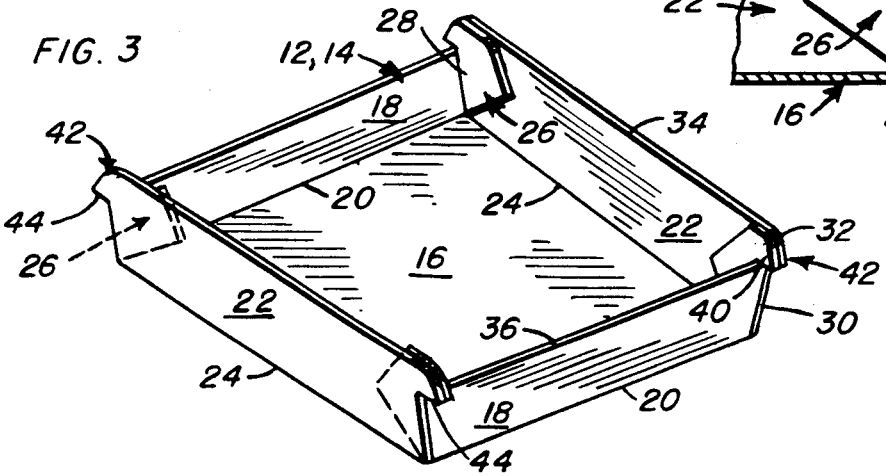
FIG. 3 is a perspective view of the basic tray and cover component.

Each of the components, noting FIG. 3, comprises a square panel 16 with a first pair of opposed low walls 18 integral with a first pair of opposed edges of the panel 16 along fold lines 20. A second pair of opposed high walls 22 are integral with the second opposed peripheral edges of panel 16 along fold lines 24. As will be appreciated from the drawings, the walls 18 and 22 are coextensive with the respective edges of the panel 16 and extend continuously thereabout. Further, and as a means for facilitating a compact nesting of the tray/cover components 12, 14, the walls 18 and 22 are slightly outwardly inclined as will be apparent from the drawings.

The walls 18 and 22 are secured in their erected positions by means of flaps 26 integrally formed at and with the opposed longitudinal ends of each low wall 18 along fold lines 28 for inward folding to lie against the corresponding inner faces of the adjacent end portions of the high walls 22 to which they are permanently affixed, preferably by an appropriate adhesive in the manner of conventional glue flaps.

Each of the high walls 22 includes, at each longitudinal end 30 thereof, a coplanar longitudinally extending tab 32 adjacent the outer edge 34 of the high wall 22. The difference in height between the high walls 22 and the low walls 18 is basically the height of the tabs 32. In other words, the high walls 22, between the corresponding fold lines 24 and the tabs 32 are of a height approximately equal to or slightly greater than the height of the low walls 18 whereby the tabs 32, as illustrated in FIG. 3, are positioned immediately above the upper edges 36 of the low walls 18 and extend outwardly beyond the low walls 18 at approximately 90 degrees thereto.

Each of the glue tabs 26 extends above the upper edge 36 of the corresponding low side wall 18 to a height, from the fold line 20 or edge of the panel 16 equal to that of the high walls 22. In that portion of each glue tab 26 above the low wall outer edge 36, each glue flap includes an integral coplanar longitudinally outwardly directed tab 40. This tab 40 is of approximately the same size as, and coextensive with the adjacent tab 32 of the adjoining high wall 22. If desired to assure proper alignment and depending on production techniques, the tabs 40 may be slightly smaller than tabs 32. The overlying tabs 32 and 40 are appropriately bonded together and define a double thickness locking lug 42 which extends transversely across and outwardly beyond the corresponding low wall 18. As will be recognized from FIG. 3, four such locking lugs 42 are provided, each extending laterally beyond an adjacent low wall 18 at each of the four corners of the component 12, 14.

Figure 4:
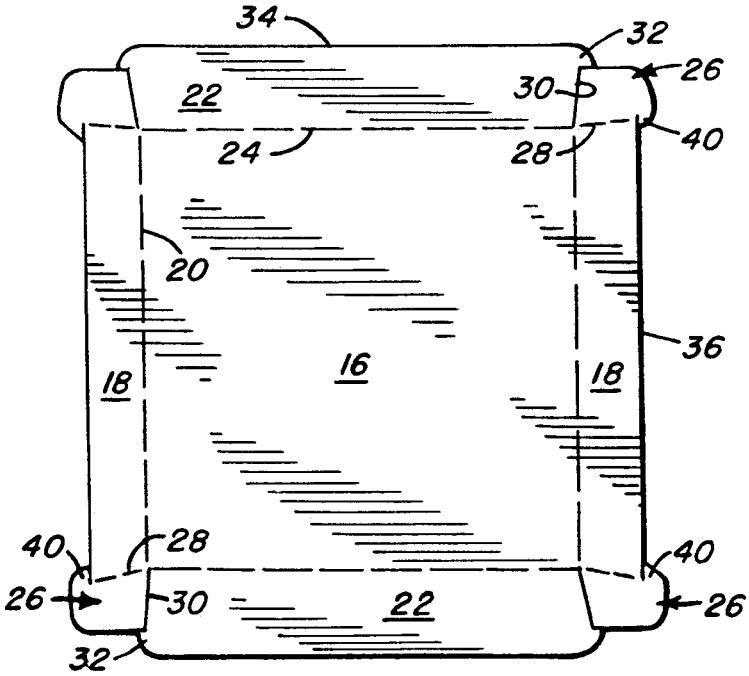
FIG. 4 is a plan view of the blank from which the tray/cover is formed.

FIG. 4 illustrates the basic blank from which the component 12, 14 is formed. The blank is planar and of an appropriate foldable paperboard with the side walls 18 and 22, and the glue flaps 26 defined by fold lines illustrated by dash lines. Each of the glue flaps 26 is separated from the adjoining end 30 of the adjacent high side wall 22 by a cut line defined along the end edge 30.

Each carton 10 consists of two of the components, one retained upright and defining the tray 12, and the other inverted and rotated 90 degrees relative to the tray to define the cover 14. When so oriented, and of course after introduction of the food product or the like, the cover 14 is downwardly introduced over the tray 12 with the locking lugs 42 of the cover 14 engaging and snapping below the locking lugs 42 of the tray 12. This locking engagement is facilitated both by the inherent flexibility of the material and by a slight taper or rounding of the upper outer corners of the locking lugs 42 which is provided for in the formation of the tabs 32 and 40 in the initial cutting of the blank. There is no necessity for a folding of the panels to engage the lugs. When engaged, the locking lugs 42 at each corner have the respective edges or shoulders 44 thereof engaging and extending across each other in a manner which precludes accidental disengagement and requires a positive manual manipulation for disengagement. Such a manipulation, noting FIGS. 1 and 2, will normally involve a slight outward pulling of at least one of the downwardly directed high side walls 22 of the cover 14 to slip the lugs thereon laterally outward and out of engagement with the corresponding lugs of the tray 12.

Figure 2:
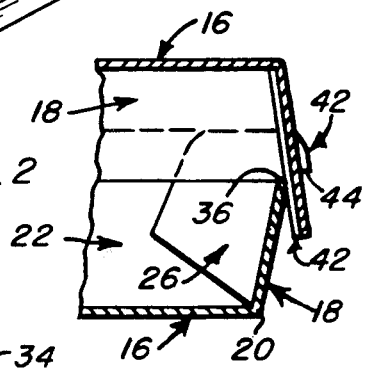
FIG. 2 is a cross-sectional detail taken substantially on a plane passing along line 2—2 in FIG. 1 and illustrating the nesting interrelationship between the tray and cover.

The cross-sectional detail of FIG. 2 is of interest in illustrating the manner in which, in the closed carton, the outer edges 36 of the low wall 18 of the cover 14 seat on the outer edges 36 of the low wall 18 of the tray 12. The relative heights of the walls and the locking lugs are such whereby the seated engagement of the cover wall edges 36 with the tray wall edges 36 does not interfere with the locking engagement of the lugs 42. Ideally, the wall edges 36 will engage simultaneously with the engagement of the locking lugs 42. As a viable alternative, the locking lugs 42 can engage prior to engagement of the edges 36.

As will be recognized, the planar panel 16 comprises a bottom or bottom panel in the tray 12 and, upon an inverting of the component, a top or top panel in the cover 14.

Figure 1:
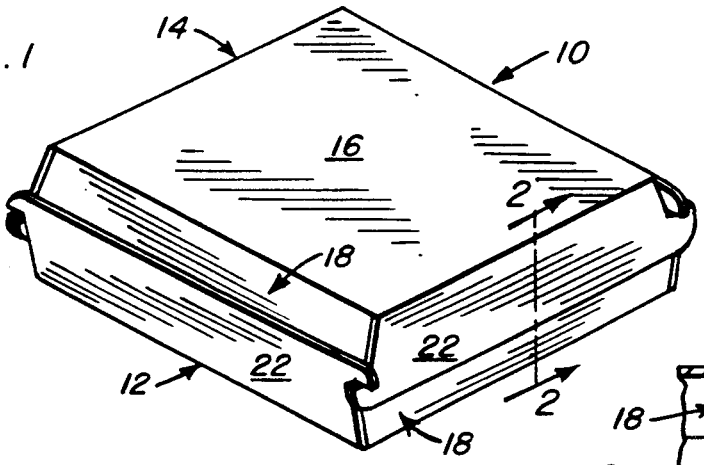
FIG. 1 is a perspective view of a closed carton comprising a separable tray and cover.

Referring now to FIGS. 5–8, the carton 50 illustrated therein is of an elongate rectangular configuration, and as such, will require a 180 degree turning of the cover 52 relative to the duplicate tray 54 for interlocking engagement in the manner of the carton 10 of FIG. 1.

Figure 6:
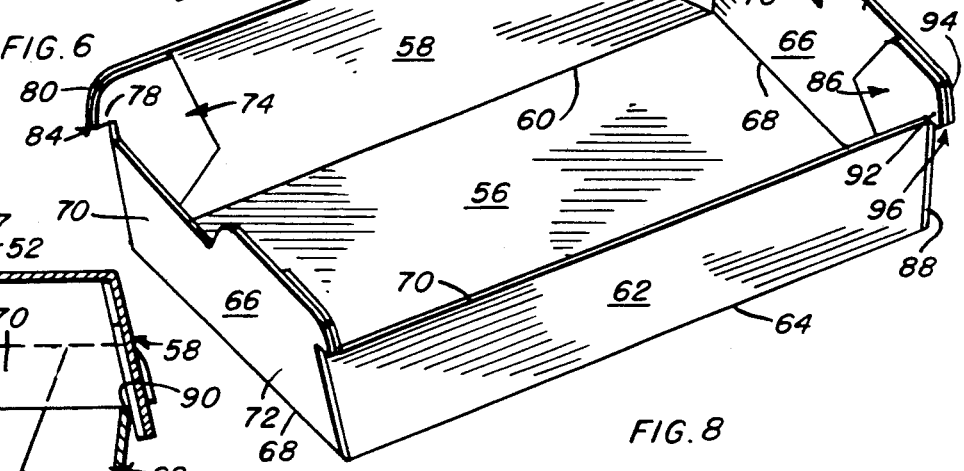
FIG. 6 is a perspective view illustrating the basic tray and cover component.

FIG. 6 illustrates the basic component which defines both the cover 52 and tray 54. This component includes a rectangular planar base panel 56. A high side wall 58 is integrally formed with one longitudinal edge of the base panel 56 along fold line 60. A longitudinally coextensive low side wall 62 is integrally formed along the opposed longitudinal edge of the base panel 56 defined by fold line 64. A pair of opposed end side walls 66 are integral with the opposed end edges of the base panel 56 along fold lines 68.

Each of the end walls 66 has a stepped upper edge defining two wall sections 70 and 72 each approximately one-half the length of the end wall. The wall section 70 is of a height substantially equal to the height of the low wall 62 and extends from a corresponding end of the high wall 58 at approximately right angles thereto. The high wall section 72 of each end wall 66 is of substantially the same height as the high wall 58 and extends from the corresponding end of the low wall 62.

Each end wall low section 70 includes a glue flap 74 integral with the end edge thereof along fold line 76 and overlying the adjacent high wall 58. This glue flap 74 is of approximately equal height with the high wall 58 and includes a coplanar tab 78 overlying the immediately adjacent portion of the upper edge of the low section 70 and extending laterally therebeyond. The tab 78 lies over a similar tab 80 integral and coplanar with the high side wall 58 and extending from the corresponding edge 82 of the adjacent high side wall 58 to combine therewith and define a double thickness projecting lug 84 which extends beyond the corresponding end side wall 66 at approximately right angles thereto.

The low longitudinally extending side wall 62 includes a pair of glue tabs 86 integral with the opposed ends thereof along fold lines 88 and extending beyond the outer edge 90 of wall 62 to a height approximately equal to that of the high side wall 58 and the high sections 72 of the end side walls 66.

Each of the glue flaps 86 overlies the inner surface of the adjacent high section 72 of the adjacent end wall 66 and is appropriately adhesively bonded thereto. Each glue flap 86 in turn includes an integral tab 92 which extends laterally beyond the low side wall 62 at approximately right angles thereto. This tab 92 overlies a similar tab 94 on the corresponding end wall high section 72 and combines therewith in forming a double thickness locking lug 96 extending laterally beyond and above the low longitudinally extending side wall 62. The carton component thus defined includes a first pair of locking lugs 84 generally coplanar with the high side wall 58 and extending beyond the opposed end side walls 66, and a second pair of locking lugs 96 coplanar with the end side walls 66 and extending beyond the low longitudinal side wall 62

Figure 8:
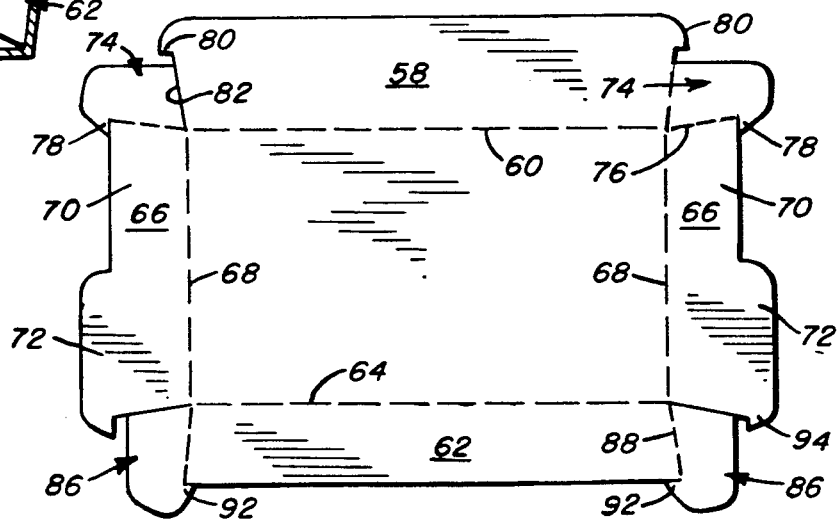
FIG. 8 is a plan view of the blank from which the tray/cover of FIG. 6 is formed.
Figure 9:
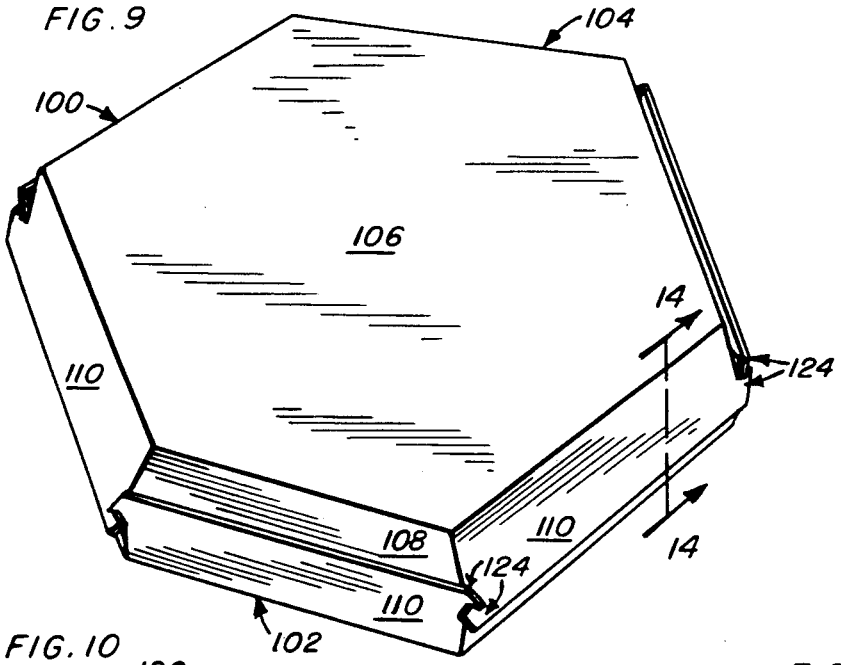
FIG. 9 is a perspective view of a hexagonal closed carton.
Figure 10:
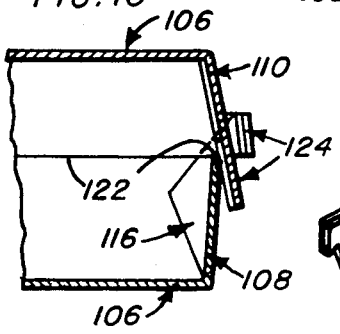
FIG. 10 is a cross-sectional detail taken substantially on a plane passing along line 10—10 in FIG. 9 and illustrating the nesting relationship of the tray and cover.

FIG. 8 illustrates the basic paperboard blank from which the carton component is formed, and indicates the relationship between the base panel 56, side walls 58, 62 and 66, glue flaps 74 and 86, and tabs 78, 80 and 92, 94.

Two of the basic tray/cover components are used to form the carton, one of which is retained upright and defines the tray 54 for the reception of foodstuff or other goods, and the other of which is inverted, for example front to rear as the component is presented in FIG. 6, to position the high side wall 58 of the cover 52 over the low side wall 62 of the tray 54. When so positioned, the projecting lugs 84 and 96 at each corner overlie each other at approximately right angles and releasably interlock through the inherently flexible nature of the material of the carton components.

Figure 5:
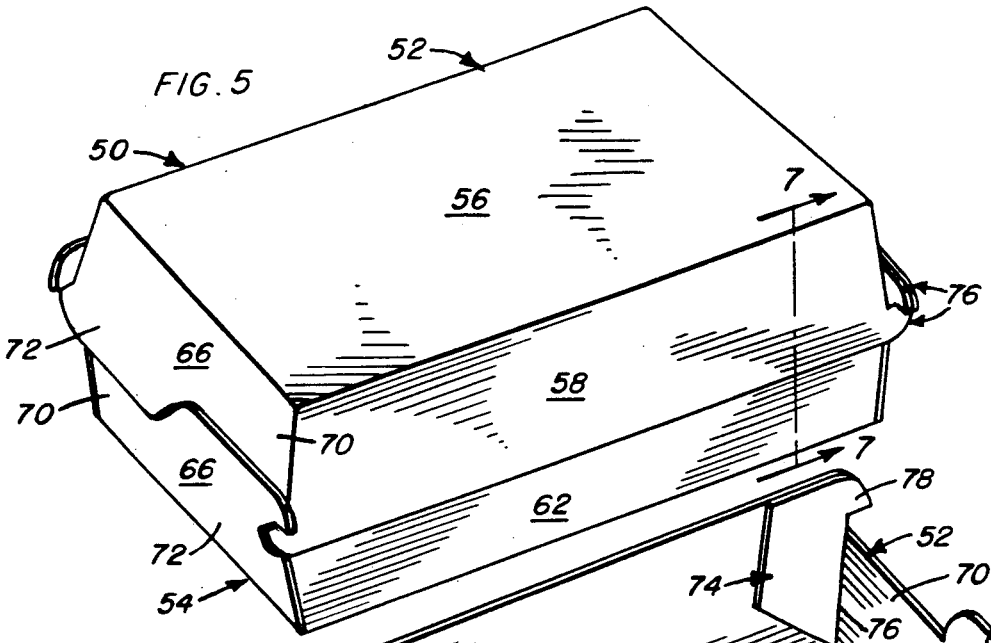
FIG. 5 is a perspective view of a rectangular embodiment of a closed compartment.

As will be appreciated from FIG. 5, when the cover 52 is locked into position over the tray 54, the high sections 72 of the end side walls 66 outwardly overlie the low sections 70 of the other tray/cover component, providing for a secure interesting with the outwardly inclined nature of the walls ensuring a proper alignment of the cover 52 to the tray 54.

Figure 7:
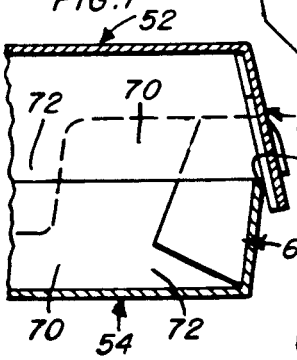
FIG. 7 is a cross-sectional detail taken substantially on a plane passing along line 7—7 in FIG. 5 and illustrating the nesting relationship between the tray and cover.

As detailed in FIG. 7, the outer edge of each low section 70, immediately adjacent the high side wall 58, seats on the upper edge 90 of the low side wall 62.

A further variation of the invention is illustrated in FIGS. 9–12 wherein the carton 100 is hexagonal, illustrating the feasibility of incorporating the features of the invention into a carton of other than four sides. The illustrated hexagonal carton 100 could find particular use as a container for pizzas.

Figure 11:
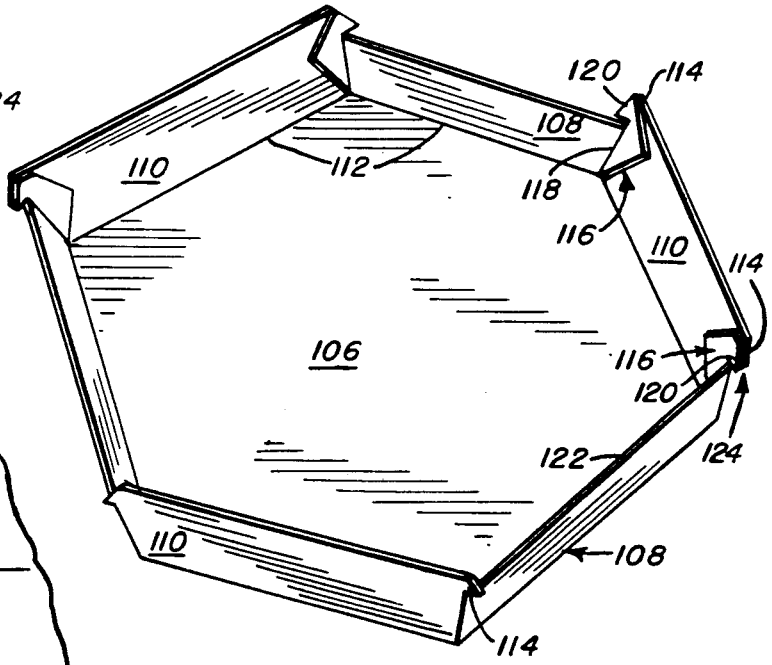
FIG. 11 is a perspective view of the basic tray and cover component of FIG. 9.

As with the previously described embodiments, the tray 102 and cover 104 are structurally duplicate components each formed as illustrated in FIG. 11. The basic component includes a flat base panel 106, which will define the bottom panel of the tray 102 or the top panel of the cover 104. Three low side walls 108 and three high side walls 110 alternate and are integrally formed along the six edges of the base panel 106 defined by fold lines 112.

Each of the high side walls 110 include integral coplanar tabs 114 at the upper end corners thereof which overlie and extend across the adjacent ends of the two adjacent low side walls 108 at an angle thereto generally commensurate with the shape of the carton component, for example 120 degrees in a hexagonal carton component. The height of each high side wall 110 over the height of the low side walls 108 is approximately equal to or slightly greater than the height of the tabs 114.

The walls 108 and 110 are engaged to define the corners by glue flaps 116 integral with the opposed ends of the low side walls 108 along fold lines 118. Each glue flap 116 lies against and is adhesively or otherwise affixed to the inner face of the immediately adjacent portion of the adjacent high side wall 110. The upper or outer portion of each glue flap 116 includes a coplanar tab 120 which generally conforms and is bonded to the tab 114 to similarly project over the upper edge 122 of the adjoining low side wall 108 and which defines, with the corresponding tab 114, a double thickness locking lug 124.

Figure 12:
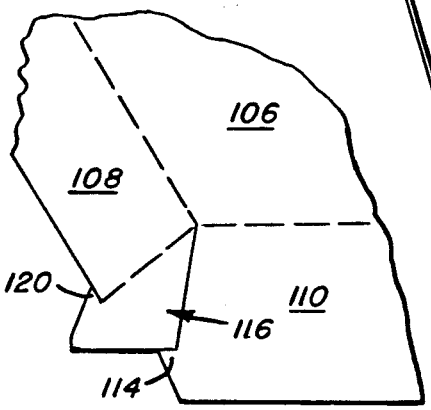
FIG. 12 is a plan view of one corner portion of the blank from which the component of FIG. 11 is formed.
Figure 13:
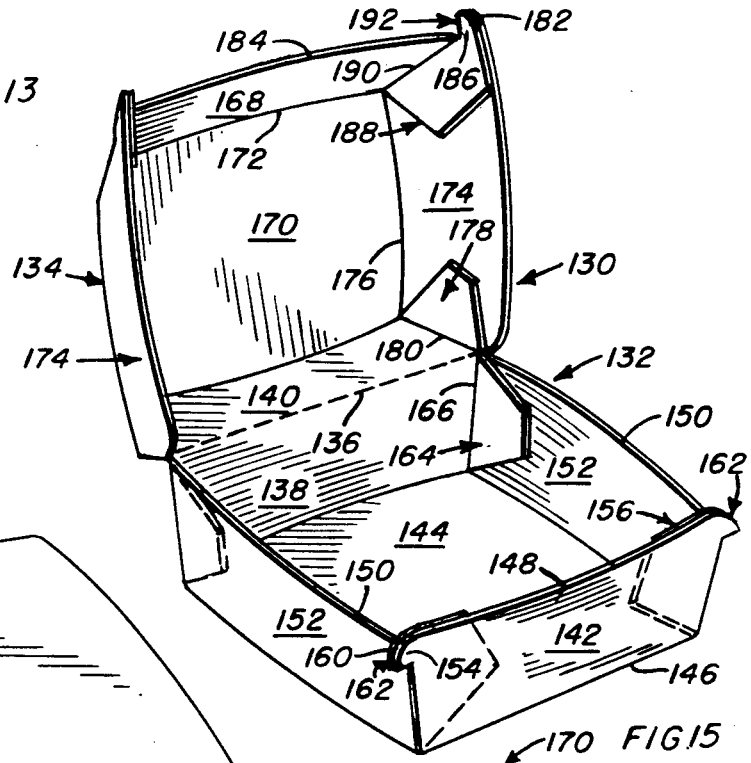
FIG. 13 is a perspective view of an open clam-shell carton.

FIG. 12 is a plan view of one corner portion of the blank from which the basic tray/cover component is formed.

When providing for a closed carton 100, one of the two duplicate components is maintained upright to define the tray 102, the second component is inverted to define the cover 104. Assuming the hexagonal configuration illustrated, the cover 104 is rotatably offset relative to the tray 102 approximately 60 degrees to align each high wall 110 of the cover over a low wall 108 of the tray, and vice versa. The slight outward angling of the walls relative to the base panel 106, in addition to allowing for nesting for storage purposes, also facilitates an alignment and telescopic interengagement of the cover over the tray with the high side walls 110 lying outward of the low side walls 108. So positioned, and as suggested in FIG. 10, the opposite end portions of the upper edge 122 of each low side wall 108 of the cover 104 engage on similar edge portions of the low side walls 108 of the tray 102 so as to position the cover 104 relative to the tray 102. When so positioned, the locking lugs 114 of the cover 104 engage and interlock immediately below the locking lugs 114 of the tray 102. This engagement is achieved by a snap-action between the lugs and the inherent flexible resiliency of the materials of the carton components. The interlocked lugs at each corner extend across each other at an angle as defined by the relationship between adjacent walls, in the illustrated embodiment, this being approximately 120 degrees.

While the tray and cover carton components in each of the above embodiments are and have been described as duplicates, it will be appreciated this relates to the structure of the components and is not intended to exclude differences in printed matter on the tray and cover, or the addition of selected elements to enhance the particular use to which the component is to be put. For example, in a carton for pizza, the tray component may additionally include a bottom overlying insert of corrugated board as an insulating pad.

Referring now specifically to FIGS. 13–16, the carton 130 illustrated therein is what is typically referred to as a clam shell carton and includes an upwardly opening tray 132 with a cover 134 integrally joined thereto along a fold line 136 respectively defining the upper edge of the rear wall 138 of the tray and the lower edge of the rear wall 140 of the cover.

The front wall 142 of the tray 132 is integrally formed along the forward edge of the base panel 144 along a fold line 146 and terminates in an upper edge 148 above the upper edges 150 of the opposed side walls 152. The side walls 152 of the tray 132 comprise low walls and are of equal height with the rear wall 138. The front wall 142 comprises a high wall and include coplanar tabs 154 extending from the opposed ends thereof above the upper edges 150 of the side walls 152 and outwardly therebeyond at approximately 90 degrees thereto.

A pair of glue flaps 156 are integrally formed with the forward ends of the side walls 152 along fold lines 158. These glue flaps 156 are of a height substantially equal to that of the high front wall 142 and, in the erected carton, lie against and are bonded to the inner face of the front wall 142 adjacent the corresponding end thereof. Each of the glue flaps 156 also includes a coplanar projecting tab 160 thereon which aligns in overlying relation to the corresponding front wall tab 154 and is bonded thereto to define a double thickness locking lug 162. The tray 132 is completed by glue flaps 164 integral with the opposed ends of the rear wall 138 along fold lines 166 with these glue flaps 164 overlapping and being bonded to the inner faces of the rear portions of the two low side walls 152 as will be readily apparent from FIG. 13.

The cover 134 includes a low front wall 168 integral with the forward edge of a top panel 170 along fold line 172. This front wall 168 is of approximately equal height with the cover rear wall 140. The cover 134 also includes a pair of opposed high side walls 174 of approximately equal height with the high front wall 142 of the tray 132. The side walls 174 are integrally formed with the opposed side edges of the top panel 170 along fold lines 176. The forward portions of the side walls 174 are secured to the cover rear wall 140 by glue flaps 178 integral with the opposed ends of the rear wall 140 along fold lines 180. These glue flaps 178 overlie and are bonded to the inner faces of the adjoining end portions of the side walls 174.

Each of the side walls 174 of the cover 134 includes a coplanar tab 182 above the outer edge 184 of the low forward wall 168 and extending thereacross and therebeyond at approximately 90 degrees. Similar tabs 186 are integral and coplanar with a pair of glue flaps 188. The glue flaps 188 are in turn integral with each end of the front wall 168 of the tray 134 along fold lines 190. Each glue flap 188 overlaps the inner face of the adjoining end portion of the adjacent side wall 174 with the glue flap tab 186 being in overlying generally coextensive relation to the corresponding side wall tab 182 to define therewith a double thickness projecting locking lug 192.

Figure 14:
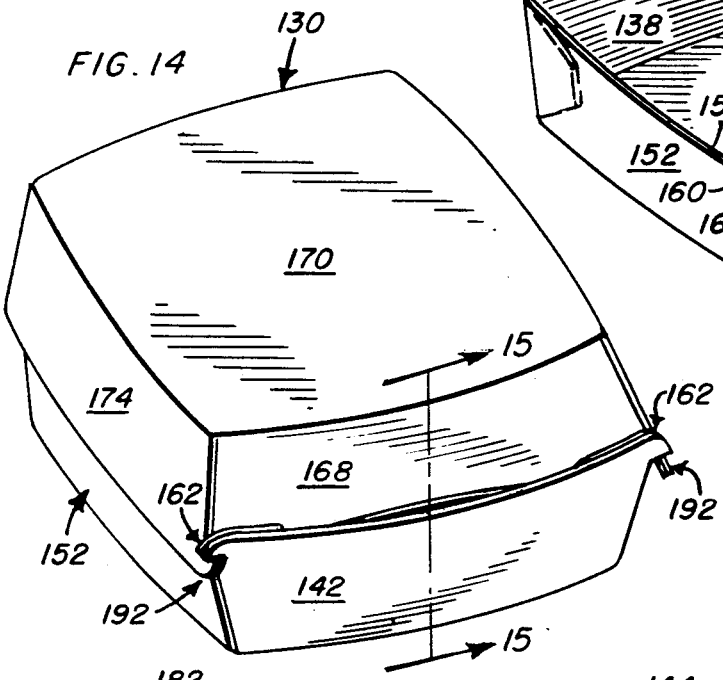
FIG. 14 is a perspective view of the clam-shell carton closed.

Upon a closing of the carton 130, noting FIG. 14, the high side walls 174 of the cover 134 overlie the low side walls 152 of the tray 132. Similarly, the low front wall 168 of the cover 134 engages inward of the high front wall 142 of the tray 132. Upon a closing of the cover 134, the forwardly projecting double thickness locking lugs 192 thereon engage and snap lock below the laterally extending double thickness locking lugs 162 on the tray 132 with the lugs, when locked, extending across each other at approximately 90 degrees.

Figure 15:
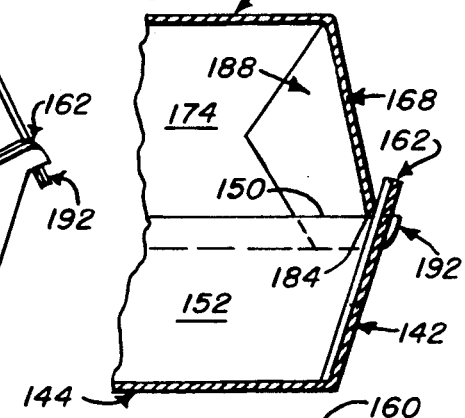
FIG. 15 is a cross-sectional detail, on a plane passing along line 15—15 in FIG. 14, of the closed carton at one of the interlocked corners thereof.
Figure 16:
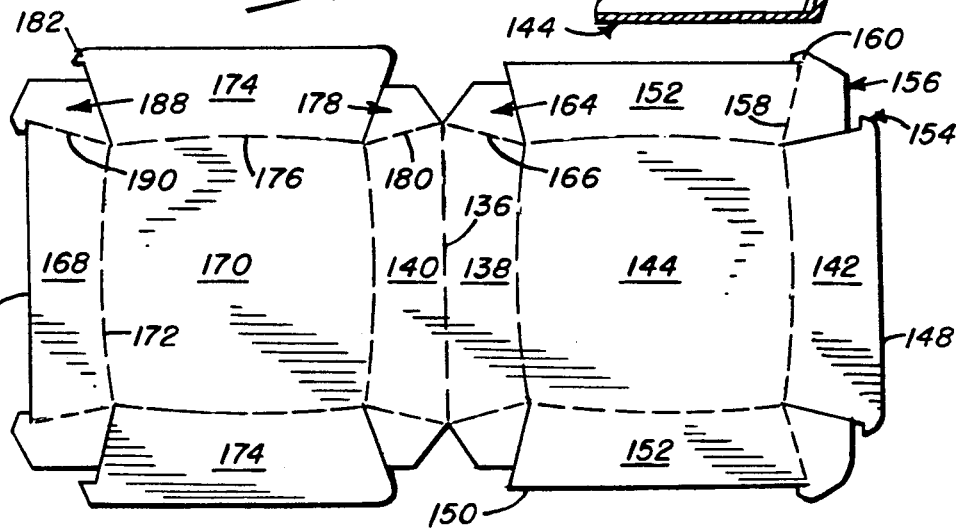
FIG. 16 is a plan view of the blank from which the clam shell carton is formed.

Noting the cross sectional detail of FIG. 15, in the closed carton, the outer edge 184 of the low front wall 168 engages on the upper edges 150 of the opposed low side walls 152 of the tray 132 adjacent the forward ends thereof and immediately inward of the front tray wall 142. The slight outward inclination of the walls of both the tray and cover facilitate the appropriate alignment of the walls and locking lugs as the cover is moved to its closed position.

In all of the above described embodiments, the glue flaps have been described as overlying and bonding to the inner faces of the adjoining side walls. As an alternative, the glue flaps can overlie and bond to the outer faces of the side walls. This would have the advantage of additional strength and rigidity at the corners.

In the formation of blanks for folded paperboard cartons, there is a continuing concern with the cutting of such blanks with minimal waste or scrap material. In conjunction therewith, if adjacent blanks can be formed with a single knife along a common cut line, this itself will greatly simplify the apparatus or equipment, as well as the actual production procedures utilized in the formation of the blanks. All of these factors provide important economic advantages.

Figure 17:
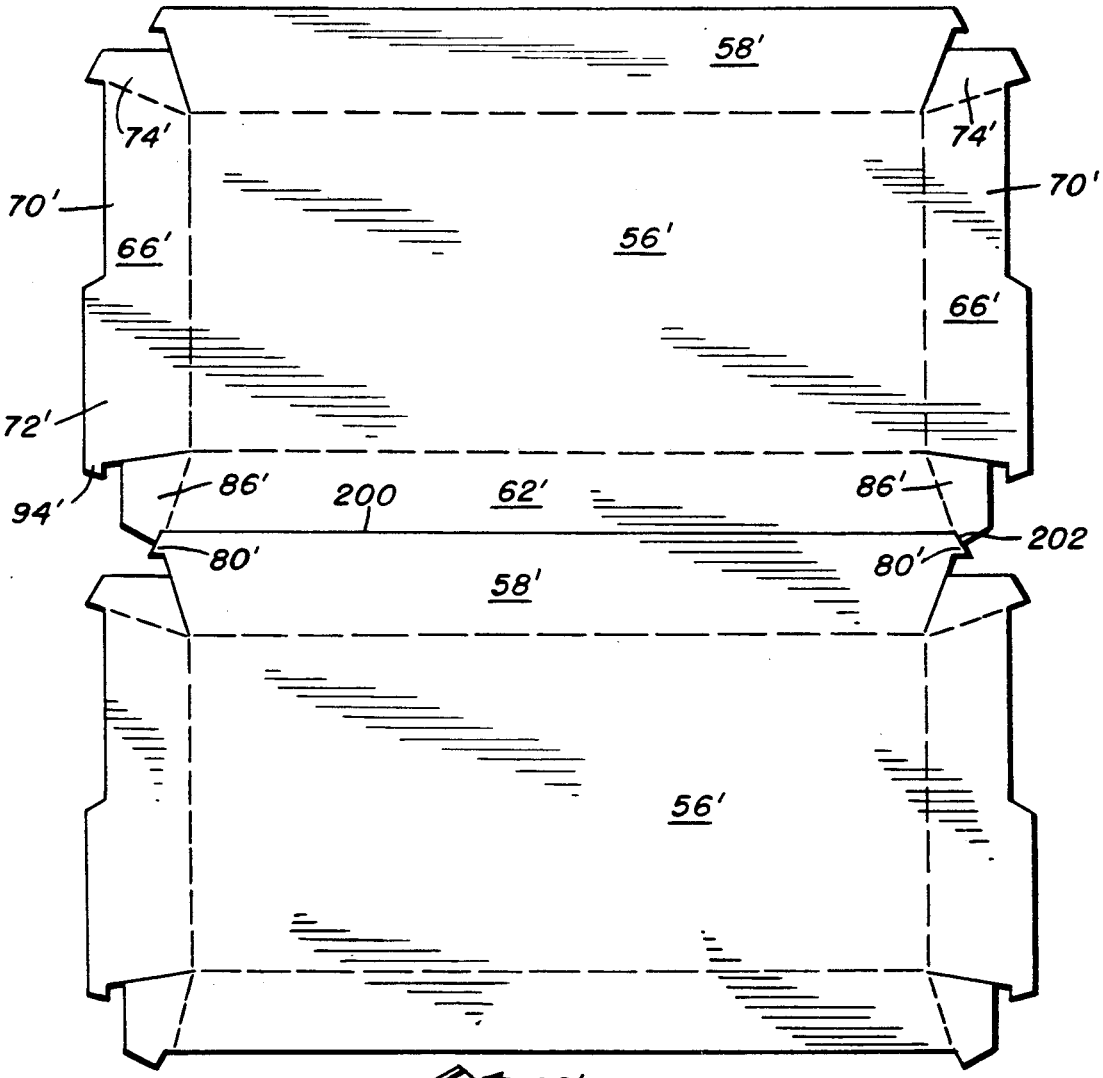
FIG. 17 is a cutting layout of a variation of the blank of FIG. 8 showing two adjoining blanks.
Figure 18:
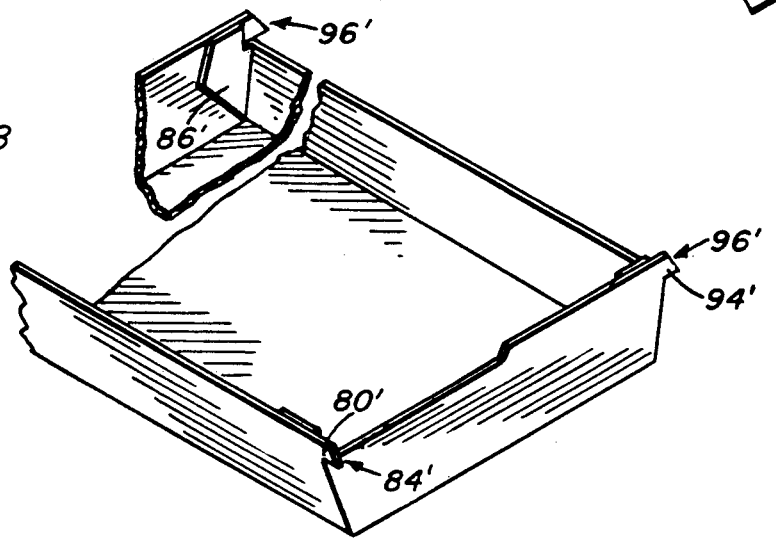
FIG. 18 is a partial perspective view of a carton component formed from a blank of FIG. 17.

As an example of how the cartons or trays of the present invention will be adapted to minimize production expenses, attention is initially directed to FIGS. 17 and 18 which disclose, respectively, blanks and an erected tray similar to those disclosed in FIGS. 5–8. In accord therewith, like components have been referred to by the same reference numerals primed.

Noting FIG. 17, it is proposed that adjacent blanks, for example along a running length of material, be defined by a single knife or cut line 200 therebetween which simultaneously defines the outer edges of the low side wall 62' of the upper blank and the high side wall 58' of the lower blank. In order to accommodate the single cut line 200, the glue flaps 86' at the opposed ends of the low wall 62' are formed without the laterally directed tabs 92 which will be noted in FIG. 8. The tabs 80' on the immediately adjacent high wall 58' of the lower blank are retained and defined by a straight cut line 202 which simultaneously defines a projecting edge portion of the adjacent low wall glue flap 86'. As will be recognized, the elimination of the glue flap tabs 92 which appear in FIG. 8 allows for the use of a single cut line between adjacent blanks.

In the opposed end walls 66', the glue flaps 74' integral with the end wall low sections 70, are also formed without the tabs 78 which appear in the embodiment of FIG. 8. Each end wall high section 72' retains its integral projecting tab 94'. The glue flaps and tabs as illustrated in FIG. 17 are defined by substantially straight line cuts as opposed to the sliqhtly rounded configurations of the previously referred to embodiments.

As will be noted in FIG. 18, when the blank of FIG. 17 is folded into an erected carton component, the projecting locking lugs 84' and 96' will consist of single tabs, 80' and 94' respectively. While the double thickness of the previously described locking lugs is not present in this embodiment, the interlock provided by the single thickness lugs is for most purposes more than adequate, particularly inasmuch as no particular stress will be placed on the interlock until such time as an actual disengagement of the cover and tray is desired. It will also be recognized that the positioning of the glue flaps immediately adjacent the lugs in the erected carton will provide an appreciable degree of stability and rigidity.

Figure 19:
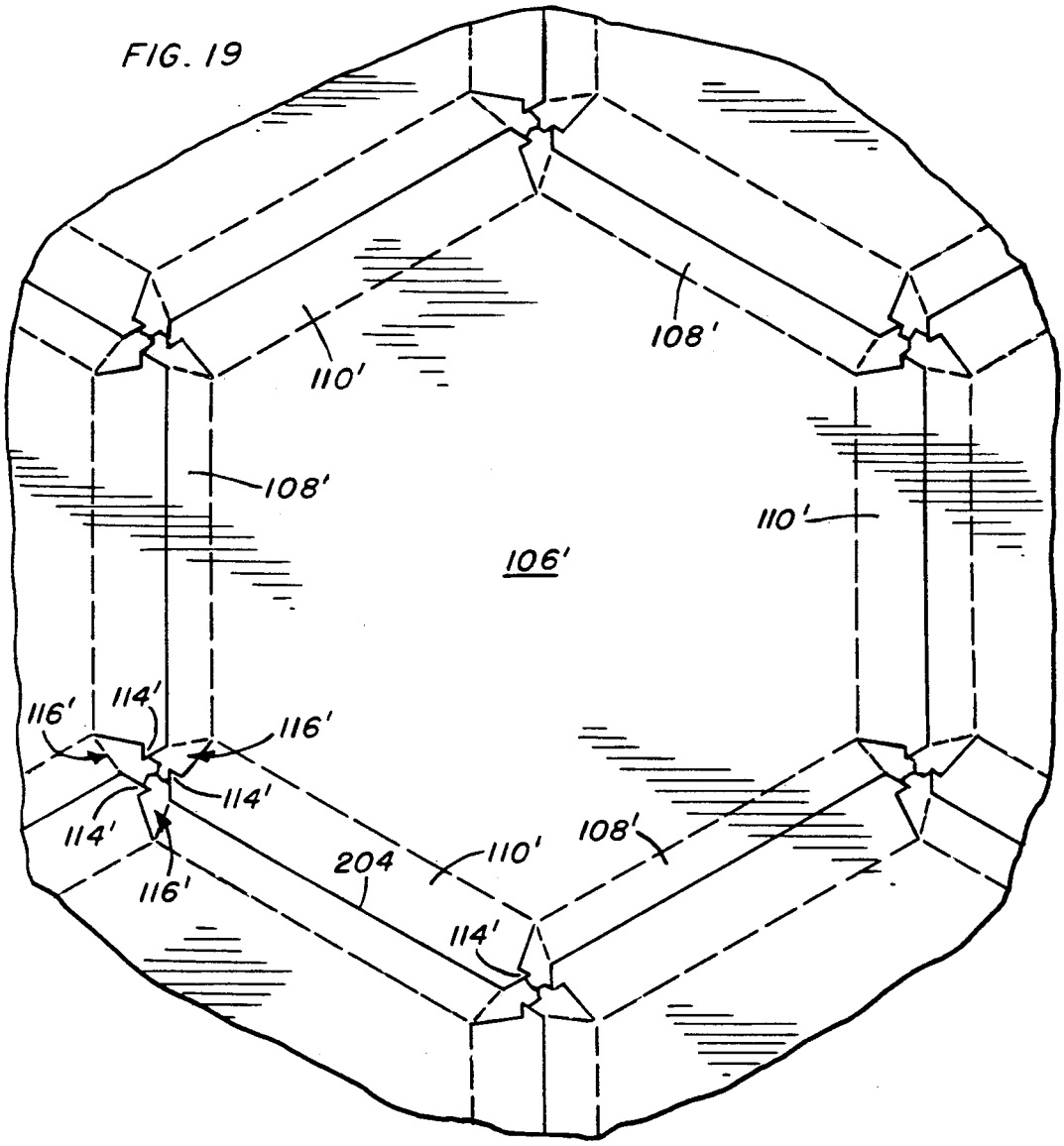
FIG. 19 is a cutting layout illustrating a hexagonal blank which is a variation of the blank suggested in FIG. 12 and illustrating the single cut line relationship of surrounding blanks.
Figure 20:
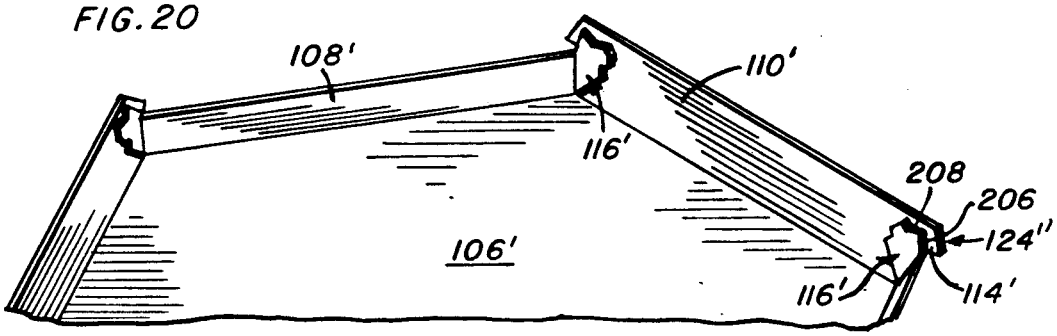
FIG. 20 is a partial perspective view of a carton component formed from the blank of FIG. 19.

Referring now to FIGS. 19 and 20, a modified form of the pizza container of FIGS. 9–12 is illustrated therein. The blank and carton formed therefrom have the portions thereof common to the earlier described carton designated by the same reference numerals primed.

As will be appreciated from FIG. 19 in particular, the three low side walls 108' and three high side walls 110' define, with the flat base panel 106', a hexagonal blank. The high side walls 110' include the integral coplanar tabs 114' at the opposed upper or outer corners thereof. However, the glue flaps 116' contain no tabs similar to the previously described tabs 120 associated with the embodiment of FIGS. 9–12. Rather, the glue flaps 116' are so configured whereby adjacent blanks, as in FIG. 19, can be defined from a sheet of paperboard material with no spacing therebetween and utilizing single knife or cut lines 204. The single cut formation of adjacent blanks with no scrap material therebetween is achieved by a perfect mating of the adjoining edges of the three glue flaps 116' of three adjacent blanks at each corner intersection of the blank layout. While one acceptable edge configuration has been illustrated, this can vary With regard to the illustrated edge configuration, attention is directed to the erected carton component of FIG. 20 wherein it will be noted that each glue flap 116' includes a first vertical edge 206 which extends for at least a major portion of the height of the immediately adjacent tab 114' which defines the single thickness lug 124'. In conjunction therewith, the upper or outer edge portion 208 of each glue flap 116' is positioned immediately below the upper edge of the high side wall 110' to which the glue flap is adhered. So positioned and arranged, the glue flaps 116' tend to reinforce and stabilize the single thickness locking lugs 124'.

The pizza carton tray and cover formed with single thickness lugs incorporate the major features of the previously described pizza carton and possess completely acceptable structural integrity and strength for use as a container for fast foods, such as pizza. In conjunction therewith, the single thickness tab form of the invention provides for substantial economies in materials used and manufacturing procedures resulting from the capability of defining or forming adjacent blanks by single cut lines therebetween.

The foregoing is considered illustrative of the principles of the invention. As other modifications and embodiments will occur to those skilled in the art, it is not and described. Rather, the invention is to only be limited by the scope of the claims following hereinafter.

I claim:

1. A carton comprising a tray, and a cover selectively movable to a position overlying and closing said tray; said tray including a bottom panel with a plurality of generally planar upstanding peripheral walls having adjacent ends defining corners spaced about said tray, at least one tray locking lug formed generally coplanar with a first one of said walls and extending outwardly at an angle across a second adjacent one of said tray walls at a defined corner therebetween; said cover including a top panel with a plurality of generally planar depending peripheral walls having adjacent ends defining corners spaced about said cover, at least one corner locking lug formed generally coplanar with a first one of said cover walls and extending outwardly at an angle across a second adjacent one of said cover walls at a defined corner therebetween; said cover locking lug being releasably interlocked with said tray locking lug when said cover is in said position closing said tray, said interlocked cover and tray lugs extending at an angle across each other, one of said walls of said tray and one of said walls of said cover being integrally joined along a fold line defining a common outer edge for a pivotal movement of said cover between said position overlying and closing said tray and a second position outwardly pivoted from said tray.

2. The carton of claim 1 wherein said tray and cover walls pivotally joined along said fold line comprise rear walls, another of said walls of said tray comprising a front wall generally parallel to said tray rear wall, said tray front wall having opposed ends, a tray lug on each of said ends and extending therefrom generally coplanar with said front wall, said walls of said cover including a pair of opposed side walls extending in spaced parallel relation to each other forward from said rear wall of said cover, a further one of said cover walls comprising a cover front wall generally parallel to said cover rear wall and extending between said cover side walls, aid cover side walls each including a cover locking lug coplanar therewith and extending forwardly beyond said cover front wall for selective engagement with said lugs on said tray front wall.

3. The carton of claim 1 including a glue flap integral with each of said second adjacent ones of said tray and cover walls and overlying and being bonded to the adjacent first ones of said walls, each of said lugs being defined by a first tab integral with the first one of said walls and a second tab integral with the overlying glue flap and bonded to said first tab to define a double thickness lug.

4. The carton of claim 1 wherein said tray and said cover are folded from a unitary paperboard blank.

5. The carton of claim 1 wherein said walls of said tray and said walls of said cover comprise low and high walls about the respective tray bottom panel and cover top panel, said lugs being generally coplanar with and extending from said high walls.

6. The carton of claim 5 including glue flaps integral with said low walls of said tray and said cover at ends thereof adjacent said high walls, said glue flaps overlying and being bonded to said adjacent high walls, said lugs each being defined by a tab on each glue flap and a generally coextensive tab on the overlaid high wall whereby lugs of double thickness are defined.

7. A carton formed from a unitary blank of folded paperboard comprising a tray and a cover integrally joined along a fold line for a selective closing of said tray by said cover, said tray comprising a bottom panel, two side walls, a rear wall and a front wall, said side walls each having a glue flap adhered to said front wall, each of said glue flaps having a tab thereof extending laterally above and beyond the associated side wall, said front wall having a tab thereon adjacent each of said side walls and overlying said glue flap tabs to define a pair of double thickness lugs, said cover comprising a top panel, two side walls, a rear wall and a front wall, said cover front wall having two glue flaps, said front wall glue flaps each being adhered to one of said cover side walls and having a tab thereon extending forwardly and above said cover front wall, each cover side wall having a tab thereon extending forwardly and above said cover front wall and extending in engagement with and coextensive with the cover glue flap tabs to form a pair of double thickness lugs selectively engaged with the tray lugs upon a closing of said cover over said tray.

* * * * *